US006206730B1

(12) United States Patent
Avery et al.

(10) Patent No.: US 6,206,730 B1
(45) Date of Patent: Mar. 27, 2001

(54) SHIELDED ELECTRICAL CONNECTOR

(75) Inventors: Hazelton P. Avery, Batavia; Emanual G. Banakis, Naperville; David E. Dunham, Aurora; Jeannette H. Legge, Buffalo Grove; David G. Mead, Naperville, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/245,020

(22) Filed: Feb. 4, 1999

(51) Int. Cl.[7] ..... H01R 13/648
(52) U.S. Cl. ..... 439/609; 439/607; 439/608
(58) Field of Search ..... 439/607, 608, 439/609

(56) References Cited

U.S. PATENT DOCUMENTS 5,017,156 * 5/1991 Sugiyama ..... 439/607
5,254,010 * 10/1993 Davis ..... 439/108
5,700,164 * 12/1997 Weidler et al. ..... 439/607

* cited by examiner

*Primary Examiner*—Lincoln Donovan
*Assistant Examiner*—Brian S. Webb
(74) *Attorney, Agent, or Firm*—A. A. Tirva

(57) ABSTRACT

A shielded electrical connector is mountable on a printed circuit board in association with an adapter for receiving a complementary mating connector. The connector includes a dielectric housing mounting a plurality of terminals having tail portions projecting from the housing for connection to appropriate circuit traces on the printed circuit board. A metal shield is mounted to the housing about the tail portions of the terminals. The shield includes at least one ESD clip for insertion into an appropriate hole in the printed circuit board, at least one ground contact arm for engaging the complementary mating connector, at least one grounding tab for engaging the adapter and at least one grounding leg for connection to an appropriate ground circuit on the printed circuit board.

16 Claims, 10 Drawing Sheets

SHIELDED ELECTRICAL CONNECTOR

FIELD OF THE INVENTION

This invention generally relates to the art of electrical connectors and, particularly, to a shielded electrical connector which includes a multi-function metal shield.

BACKGROUND OF THE INVENTION

Electrical connectors are used in a wide variety of applications ranging from simple connecting interfaces between hard conductor wiring to more sophisticated applications involving such components as printed circuit boards, flat flexible cables and optical fibers. Basically, electrical connectors include some form of contacts, terminals or other conductors which interconnect one electrical device to another electrical device. The electrical connectors may involve systems whereby the connectors provide receiver-transmitter functions which, in addition, can convert high speed signals from solid (copper) cables or fiber optic cables to high speed signals on a system printed circuit board. As used herein, the terms "electrical" or "electrical connectors" are intended to include optical devices.

For instance, in the telecommunications industry, switching systems or circuitry may be provided on a rather sizable mother board at a particular location. A plurality of high speed electrical converter modules are mounted by appropriate frame structures on the mother board. Mating "plug-in" connector modules are plugged into the converter modules from outside the switching system. The incoming signals from the cables attached to the plug-in modules are at high speed, such as in the gigabit range, and the converter modules transfer and maintain the signals at high speed and transmit them to the circuitry on the mother board. Continuing problems have been encountered in the design and manufacturability of such systems. Many of the problems center around providing adequate protection for the connecting interface from electromagnetic interference (EMI) as well as providing protection against electrostatic discharge (ESD). The present invention is directed to solving those problems by providing a simple system which is cost effective to manufacture, assemble and use, and which provides extensive EMI and ESD protection.

SUMMARY OF THE INVENTION

An object, therefore, of the invention is to provide a new and improved shielded electrical connector for mounting on a printed circuit board in association with an adapter for receiving a complementary mating connector.

In the exemplary embodiment of the invention, the connector includes a dielectric housing having a forward mating end and a rear terminating end, with a plurality of terminal-receiving passages extending therebetween. A plurality of terminals are received in the passages and include tail portions projecting from the terminating end of the housing for connection to appropriate circuit traces on the printed circuit board. A one-piece stamped and formed sheet metal shield is mounted about at least the rear terminating end of the housing. The shield includes at least one integral ESD clip projecting downwardly for insertion into an appropriate mounting hole in the printed circuit board. The shield includes at least one integral contact arm projecting forwardly for engaging the complementary mating connector. The shield includes at least one integral grounding tab projecting outwardly for engaging the adapter. The shield includes at least one integral grounding leg projecting downwardly for connection to an appropriate ground circuit on the printed circuit board.

As disclosed herein, the shield includes a top wall, a rear wall and a pair of side walls. A pair of the ground contact arms project forwardly from the pair of side walls. The grounding leg projects downwardly from the rear wall. The grounding tab projects outwardly from the top wall. A pair of the ESD clips project downwardly from the pair of side walls.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
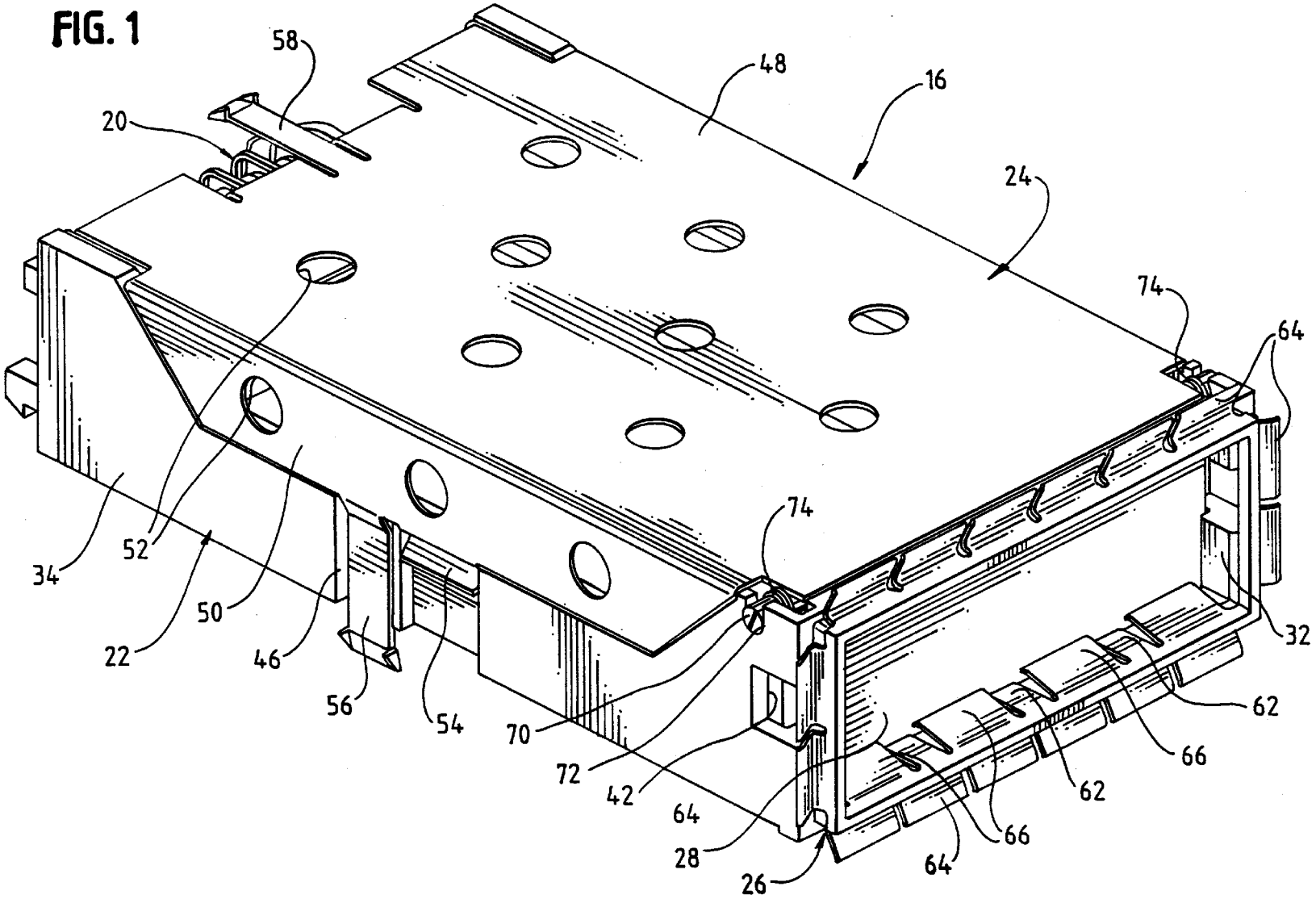
FIG. 1 is a top front perspective view of the adapter frame assembly incorporating the concepts of the invention.
Figure 2:
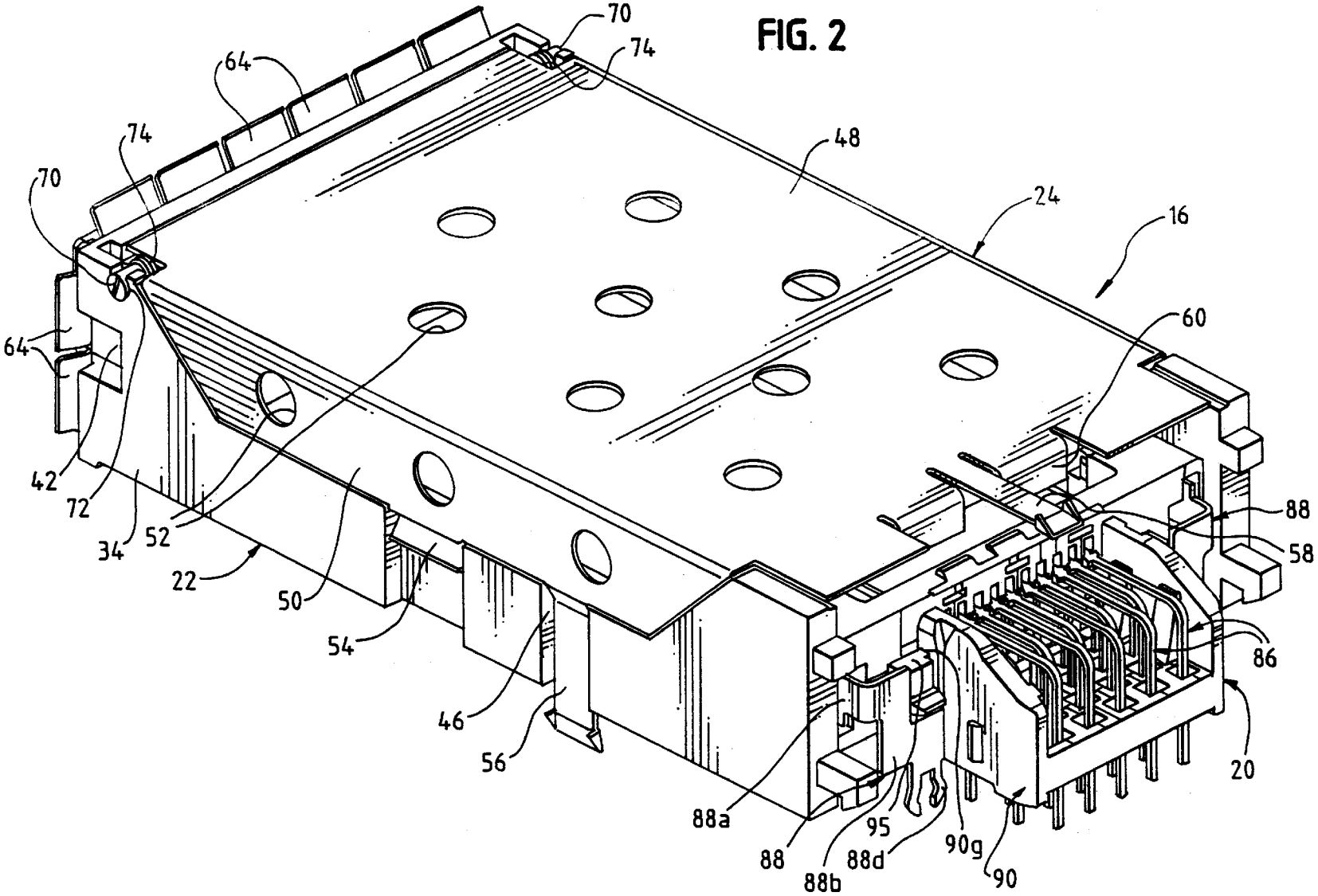
FIG. 2 is a top rear perspective view of the assembly and showing the board mounted connector.
Figure 3:
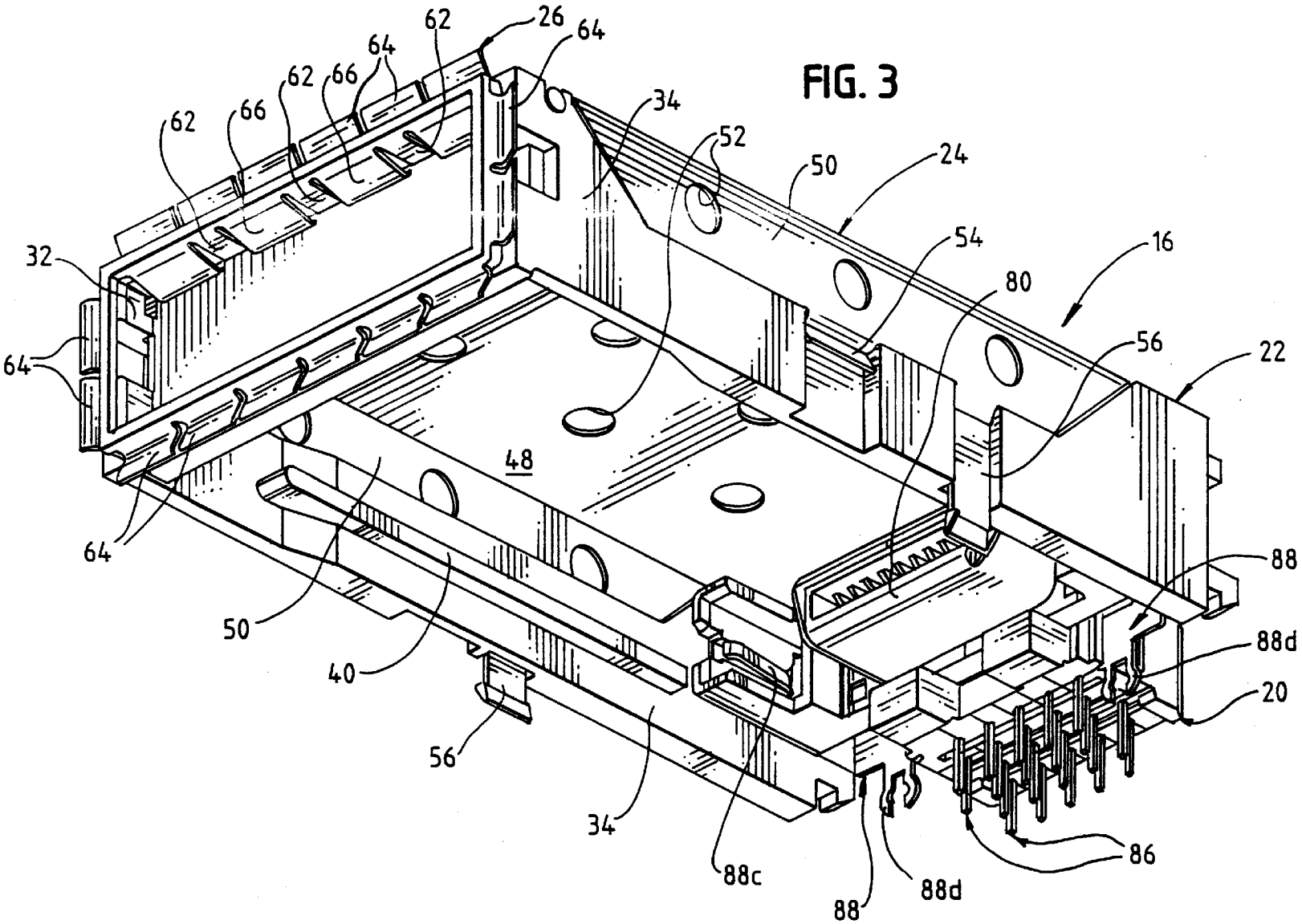
FIG. 3 is a bottom perspective view of the adapter frame assembly and board mounted connector.

Referring to the drawings in greater detail, and first to FIGS. 1–5, a metal adapter frame assembly, generally designated 16, is designed for mounting a first electrical connector, generally designated 18 (FIGS. 4 and 5), in an aperture in a panel and a second electrical connector, generally designated 20 (FIGS. 1, 2 and 5), mountable on a printed circuit board. The panel and its aperture, as well as the printed circuit board, are not shown in the drawings but are of conventional construction. Suffice it to say, the aperture in the panel is generally rectangular to receive the front rectangular end of the adapter frame assembly, as described hereinafter.

Figure 4:
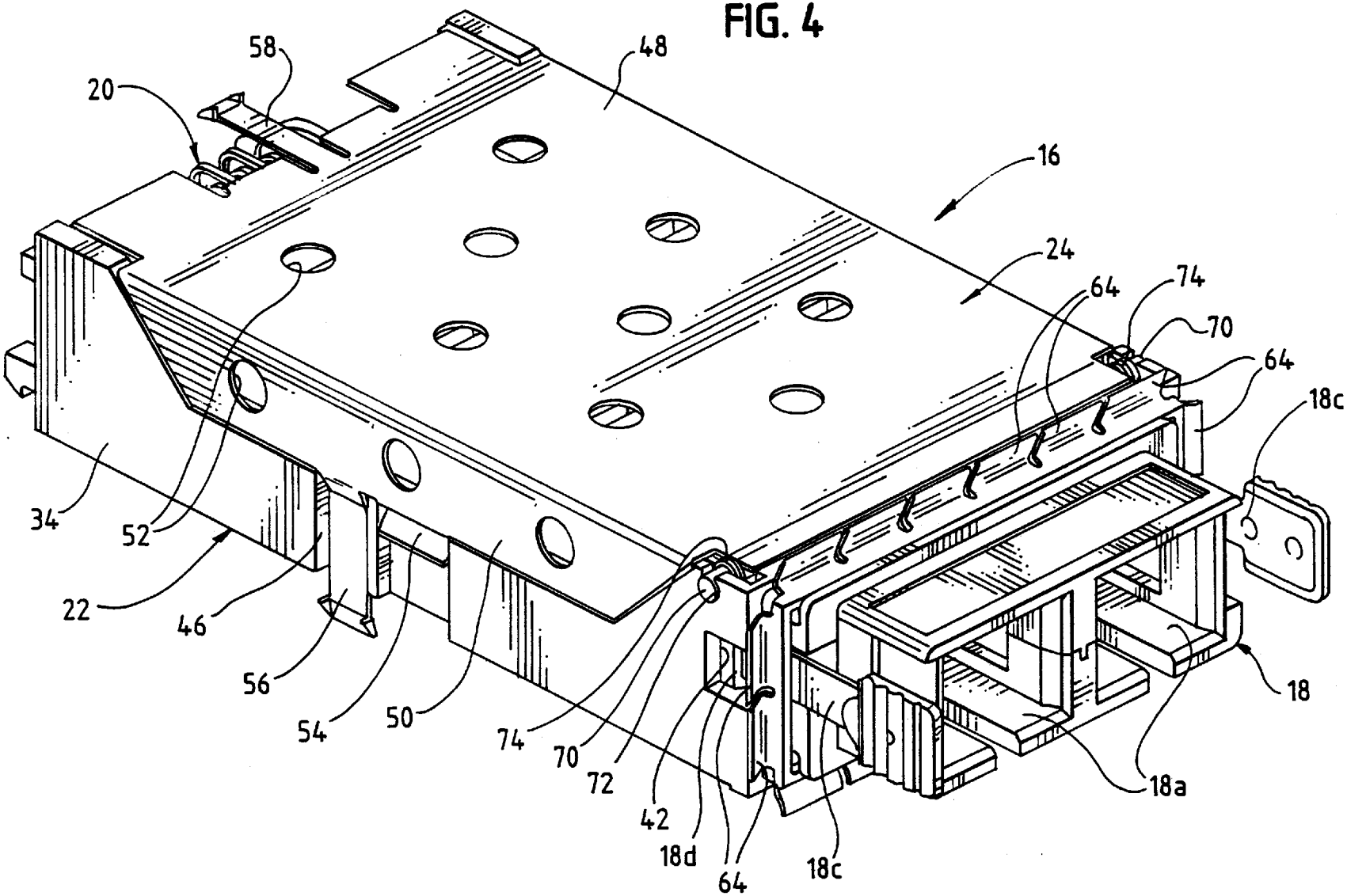
FIG. 4 is a view similar to that of FIG. 1, but including the plug-in connector.
Figure 5:
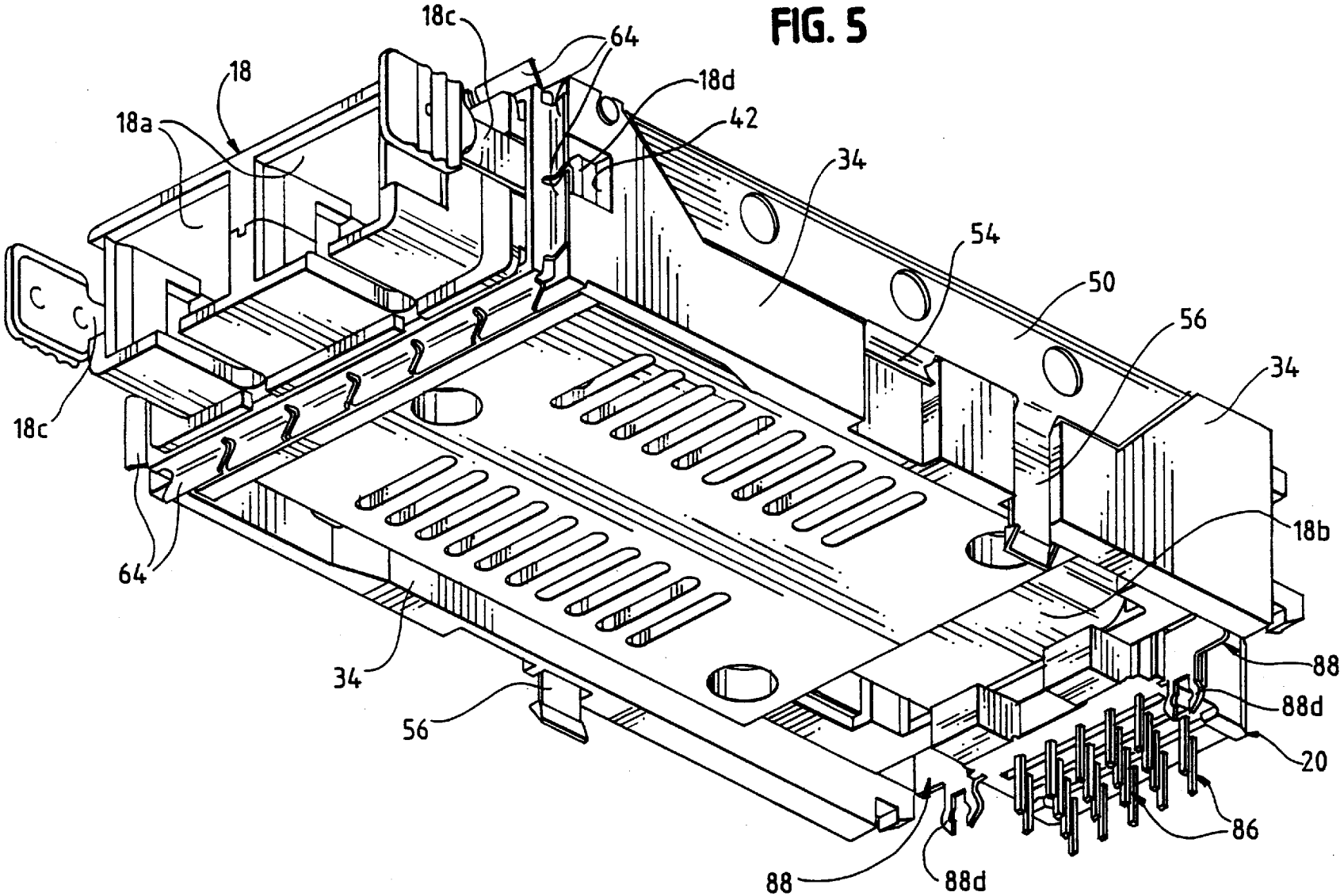
FIG. 5 is a view similar to that of FIG. 3, but including the plug-in connector.
Figure 6:
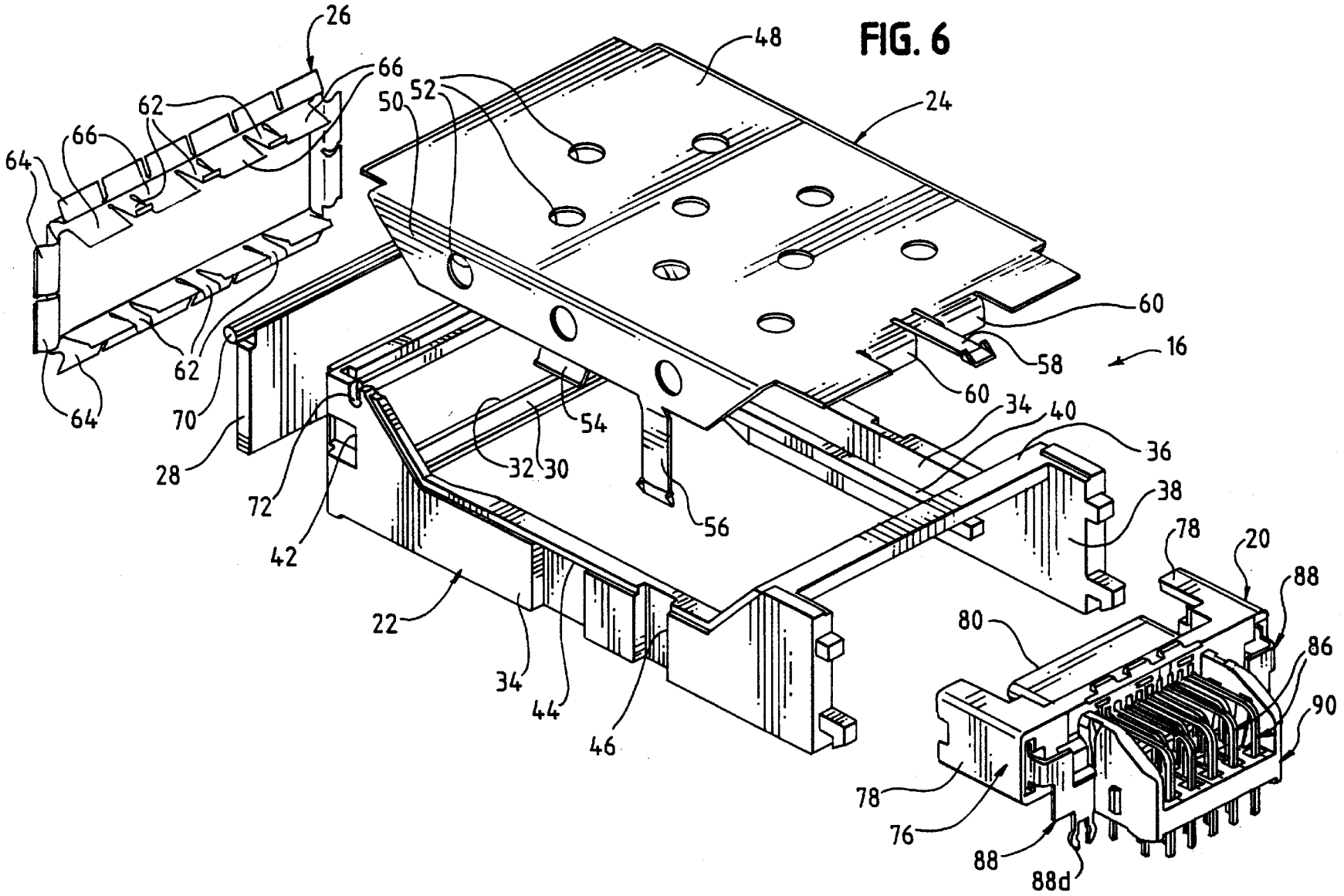
FIG. 6 is an exploded perspective view of the adapter frame assembly, in conjunction with the board mounted connector.

Referring to FIG. 6 in conjunction with FIGS. 1–5, adapter frame assembly 16 includes four main components, namely: a diecast metal body, generally designated 22; a stamped and formed shielding cover, generally designated 24; a stamped and formed sheet metal gasket, generally designated 26; and a diecast metal shutter member, generally designated 28. Body 22 and shutter member 28 may be diecast of nickel-plated zinc material. Shielding cover 24 may be stamped and formed from spring steel material plated with a bright tin material. Gasket 26 may be stamped and formed from a beryllium copper material plated with a bright tin material.

Diecast metal body 22 includes a front wall 30 (FIG. 6) defining a rectangular front receptacle 32, a pair of rearwardly extending side walls 34 and a top rear bridge 36 joining the side walls to define an open-bottom rear receptacle 38. Plug-in connector 18 is inserted into front receptacle 32, and board connector 20 is received in rear receptacle 38. Guide rails 40 are formed on the inside of side walls 22 for guiding the plug-in connector. Latch openings 42 are formed in side walls 34 for receiving latches of the plug-in connector, as described hereinafter. A latch shoulder 44 and a latch groove 46 are formed on the outside of each side wall 34 for cooperating with components of shielding cover 24, as described below.

Specifically, stamped and formed sheet metal shielding cover 24 includes a top wall 48 and a pair of side walls 50. It can be seen in FIG. 6 that diecast metal body 22 is open at the top and recessed at the sides thereof, and the top wall and side walls of the shielding cover completely close the top and sides of the body. A plurality of ventilating holes 52 are stamped out of the top and side walls of the shielding cover. A spring latch tab 54 depends from each side wall 50 of the shielding cover for snapping beneath latch shoulder 44 of the respective side wall of the body to hold the cover on the body. A latch arm 56 depends from each side wall of the cover and extends through groove 46 in the respective side wall of the body, beyond the bottom of the body for insertion into an appropriate mounting hole in the printed circuit board to hold the adapter frame assembly to the board. A third latch arm 58 extends rearwardly of top wall 48 of the cover. Therefore, the adapter frame assembly can be mounted to the circuit board in a horizontal position by using latch arms 56, or in a vertical position by using latch arm 58. Finally, a pair of engagement tabs 60 depend from top wall 48 of the cover at the rear thereof, on opposite sides of latch arm 58, for purposes described hereinafter.

Stamped and formed sheet metal gasket 26 is generally rectangular corresponding to rectangular front receptacle 32 of body 22. The gasket includes a plurality of flexible stamped and formed latch arms 62 at the top and bottom thereof for snapping behind front wall 30 of body 20 to hold the gasket to the body surrounding front receptacle 32. The gasket includes a plurality of outwardly deformed flexible fingers 64 on all four sides thereof for engaging the panel about the rectangular aperture therein. The gasket includes a plurality of inwardly deformed flexible fingers 66 on the top and bottom thereof for engaging an exterior shield of plug-in connector 18.

Shutter member 28 is mounted behind front receptacle 32 of body 22 by means of a pivot boss 70 projecting from each opposite end of the shutter member at the top thereof, for seating into grounded recesses 72 in side walls 34 of the body. A coil spring 74 is wrapped about each pivot boss 70, with opposite ends of the coil spring anchored to the shutter member and to the body in a manner such that the springs bias the shutter member to a closed position as seen in FIG. 1, i.e. closing front receptacle 32. The shutter member is automatically opened against the biasing of the springs by engagement with plug-in connector 18 when the connector is inserted into the front receptacle.

Referring specifically to FIGS. 4 and 5, plug-in connector 18 can take a wide variety of configurations. For instance, the plug-in connector could be a converter module which carries signals at high speeds, such as in the gigabit range. Such converter modules receive high speed signals and transfer and maintain the signals at high speed for transmission to board mounted connectors, such as board mounted connector 20. Although not part of the invention herein, the plug-in converter module includes a pair of receptacles 18*a* at the front end thereof and a mating end 18*b* (FIG. 5) at the rear end thereof. A pair of flexible latch arms 18*c* on opposite sides of the plug-in connector include latch hooks 18*d* for snapping into latch openings 42 in the side walls of body 22 of the adapter frame assembly.

Figure 7:
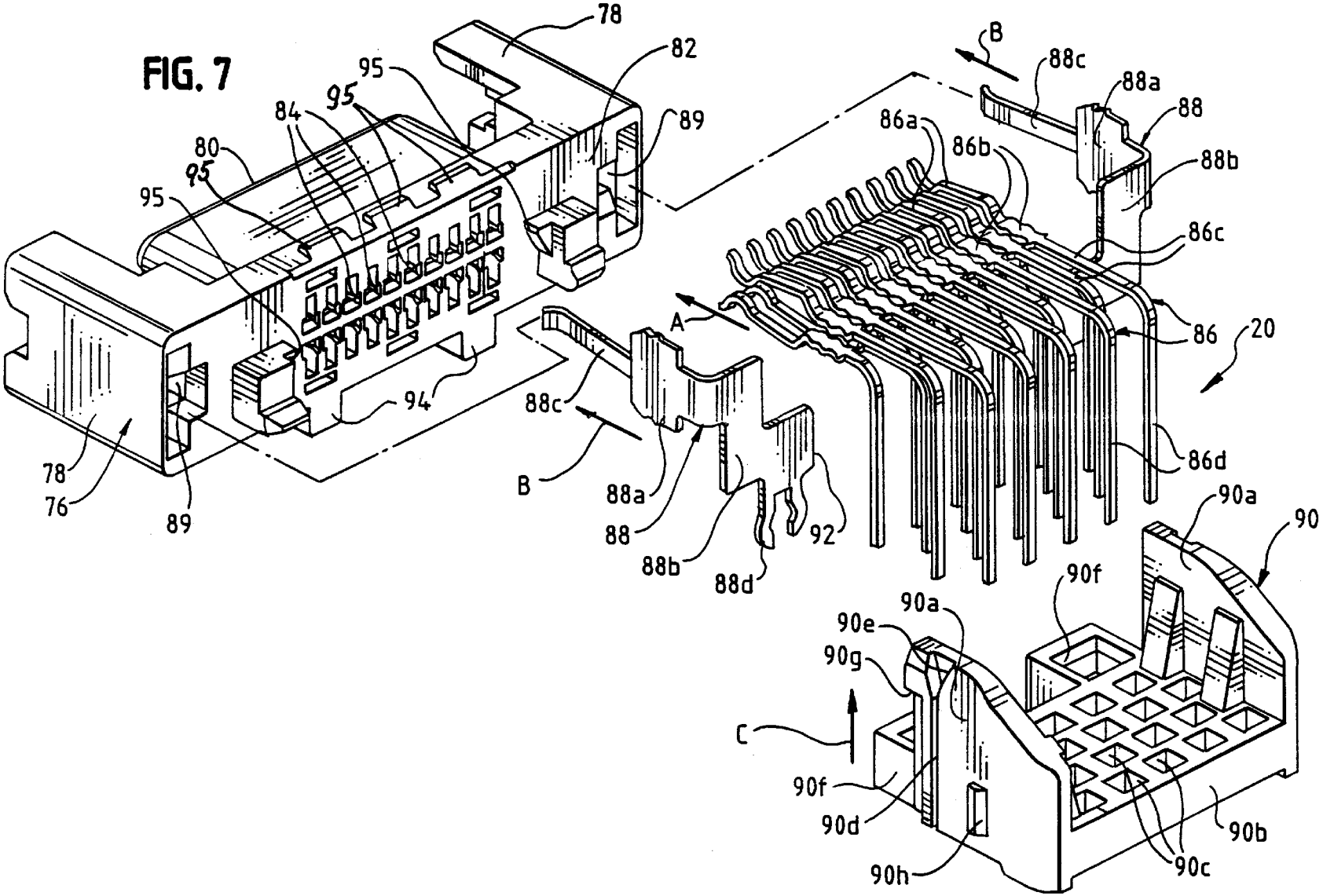
FIG. 7 is an exploded perspective view of the board mounted connector.
Figure 8:
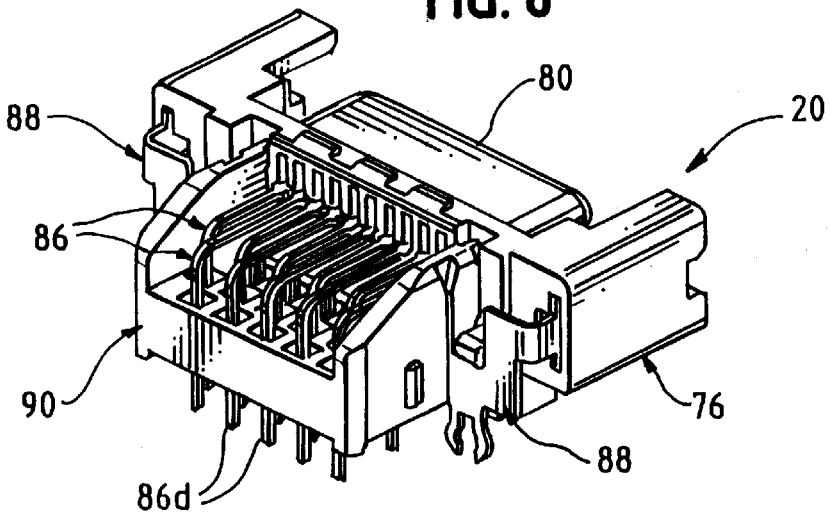
FIG. 8 is a perspective view of the board mounted connector taken at an opposite angle from that of FIG. 6.
Figure 9:
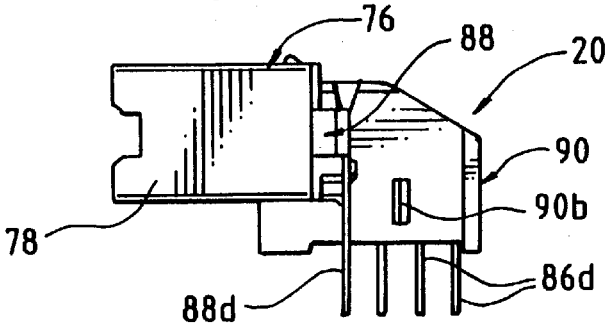
FIG. 9 is a side elevational view of the board mounted connector.

Referring to FIGS. 7–9 in conjunction with FIGS. 2, 3, 5 and 6, board mounted connector 20 includes a one-piece housing, generally designated 76, unitarily molded of dielectric material such as plastic or the like. The housing has a pair of forwardly directed side arms 78 for positioning the housing within rear receptacle 38 (FIG. 6) of body 22 of shielding cover 24. The housing has a forward mating end 80 for mating with rear mating end 18*b* (FIG. 5) of plug-in connector 18. The housing has a rear terminating end 82, with a plurality of terminal-receiving passages 84 in the housing extending between mating end 80 and terminating end 84.

A plurality of terminals, generally designated 86 (FIG. 7) include forwardly directed contact portions 86*a* for insertion into terminal-receiving passages 84 in the direction of arrow "A". The contact portions of the terminals engage appropriate contacts within plug-receiving connector 18. Each terminal 86 includes an enlarged body portion 86*b* having teeth stamped in the sides thereof for securing the terminals within housing 76. Each terminal 86 includes a tail portion 86*c* projecting rearwardly from rear end 82 of housing 76. The tail portions include right-angled end portions 86*d* for insertion into appropriate holes in the printed circuit board for connection, as by soldering, to circuit traces on the board and/or in the holes.

Board mounted connector 20 includes a pair of ground members, generally designated 88. Each ground member is stamped and formed of conductive sheet metal material and includes a securing body portion 88*a* for insertion into one of a pair of passages 89 in housing 76 in the direction of arrows "B". An abutting body portion 88*b* of the ground member abuts against rear end 82 of housing 76 when the ground member is fully inserted into passage 89. A ground contact arm 88*c* projects forwardly from securing body portion 88*a* for engaging a grounding shield of plug-in connector 18. A bifurcated ESD clip 88*d* projects downwardly from abutting body portion 88*b* for insertion into an appropriate mounting hole in the printed circuit board and for engaging the plated inside diameter of the hole, the plating being of a ground circuit.

Board mounted connector 20 also includes a tail aligner, generally designated 90, mounted to rear end 82 of housing 76. After terminals 86 are inserted into the housing in the direction of arrow "A", and ground members 88 are inserted into the housing in the direction of arrows "B", tail aligner 90 is mounted to the housing in the direction of arrow "C". The tail aligner includes a pair of side walls 90*a* upstanding from a bottom wall 90*b* having a plurality of apertures 90*c* through which end portions 86*d* of the terminals extend, whereby the tail aligner aligns and maintains proper positioning and spacing of the end portions of the terminals for insertion into a precise array of holes in the printed circuit board. Slots or grooves 90*d* are formed in the outside of sides walls 90*a* for receiving edges 92 of ground members 88 to stabilize the ground members and especially ESD clips 88*d*. The grooves have diverging mouths 90*e* to facilitate guiding the edges of the ground members into the grooves. A pair of apertured mounting bosses 90*f* project forwardly of bottom wall 90*b* of the tail aligner for receiving a pair of mounting posts 94 depending from housing 76 for guiding purposes. A pair of latch shoulders 90*g* on the outsides of side walls 90*a* snap over a pair of latch shoulders 95 projecting from the rear of the housing to lock the tail aligner to the housing. Finally, a chamfered latch boss 90*h* projects outwardly from each side wall 90*a* of the tail aligner and three chamfered latch bosses 95 project upwardly from housing 76 for optionally mounting a shield thereon, as described below.

Figure 10:
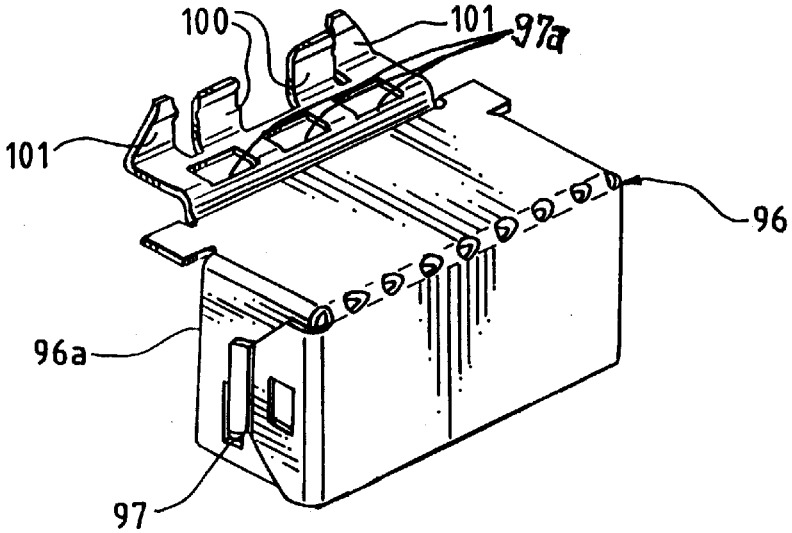
FIG. 10 is a perspective view of a shield which can be retrofitted onto the board mounted connector of FIGS. 6–9.

FIG. 10 shows a stamped and formed metal shield, generally designated 96, for mounting over tail aligner 90 after the tail aligner is mounted to housing 76 of board mounted connector 20. The shield is snapped onto tail aligner 90 by means of a pair of apertures 97 in the side walls of the shield for snapping over latch bosses 90*h* of the tail aligner and three apertures 97*a* in the top of the shield for snapping over latch bosses 95 of the housing to hold the shield thereon. Specifically, shield 96 is a box-like structure having a pair of integral inside grounding tabs 100 between a pair of outside tabs 101 for engaging engagement tabs 60 (FIG. 6) of shielding cover 24 to common the shielding cover of the adapter frame assembly with the shield of the plug-in connector. Tabs 60 on the cover slide between tabs 100 and tabs 101 of the shield. Shield 96 can be employed as a retrofit component to provide EMI protection for connector 20. Front edges 96*a* of the shield engage ground members 88.

Figure 11:
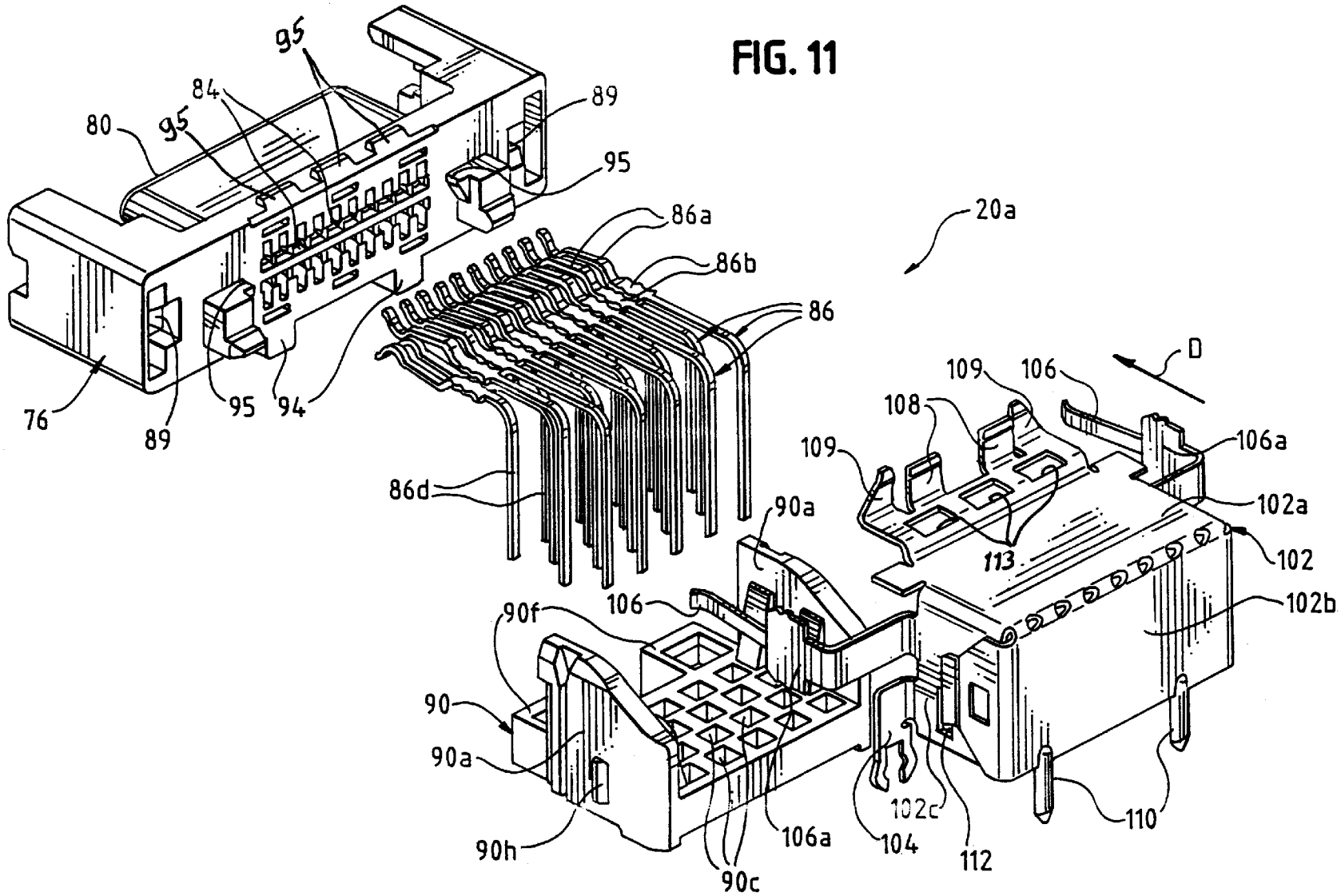
FIG. 11 is an exploded perspective view of an alternate embodiment of the board mounted connector.
Figure 12:
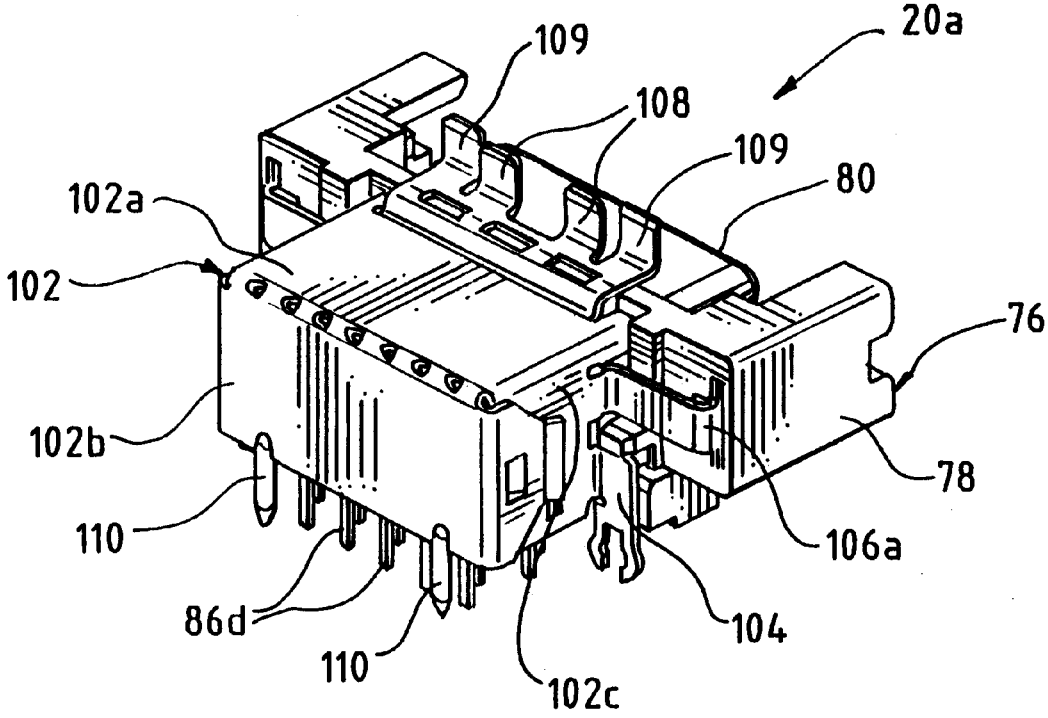
FIG. 12 is a perspective view of the board mounted connector of FIG. 11, in assembled condition.
Figure 13:
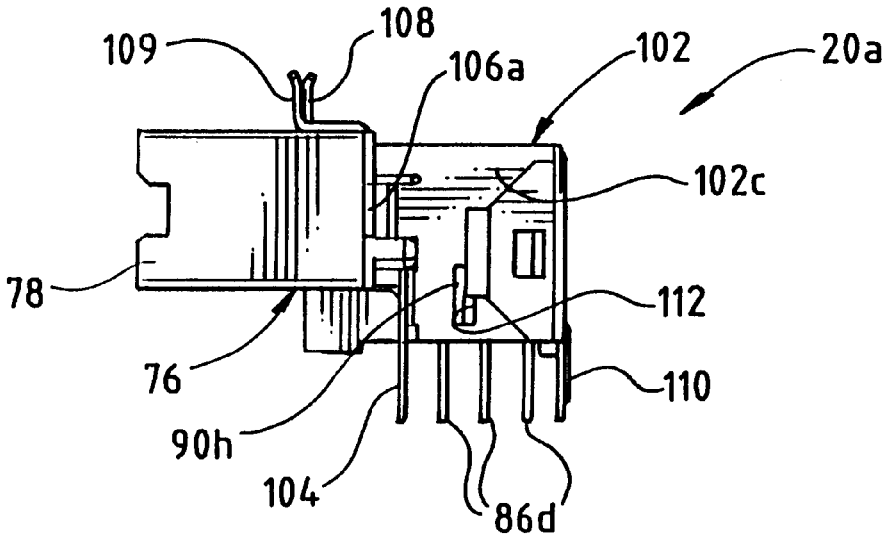
FIG. 13 is a side elevational view of the board mounted connector of FIG. 12.

FIGS. 11–13 show an alternate embodiment of a board mounted connector, generally designated 20A. This alternate embodiment of the board mounted connector includes a housing 76, a plurality of terminals 86 and a tail aligner 90 identical to the housing, terminals and tail aligner described above in relation to board mounted connector 20 shown in FIGS. 7–9. Consequently, like numerals have been applied in FIGS. 11–13 corresponding to the description above in relation to FIGS. 7–9. In connector 20A, a unitary shield, generally designated 102, incorporates the ground contact arms and ESD clips of ground members 88 in connector 20.

More particularly, shield 102 is a one-piece stamped and formed sheet metal component having a box-like configuration defined by a top wall 102*a*, a rear wall 102*b* and a pair of side walls 102*c*. An integral bifurcated ESD clip 104 projects outwardly and downwardly from each side wall 102*c* for insertion into an appropriate mounting hole in the printed circuit board. An integral ground contact arm 106 projects forwardly from each side wall 102*c* for engaging the plug-in connector 18. A pair of integral inside grounding tabs 108 project upwardly from the front of top wall 102*a*, between a pair of outside grounding tabs 109, for engaging engagement tabs 60 (FIG. 6) of shielding cover 24 of adapter 16. A pair of integral grounding legs 110 project downwardly from rear wall 102*b* for insertion into appropriate holes in the circuit board and for connection, as by soldering, to ground circuits on the board and/or in the holes.

Shield 102 is assembled to board mounted connector 20A in the direction of arrow "D" (FIG. 11) until latch apertures 112 in side walls 102*c* of the shield snap behind chamfered latch bosses 90*h* projecting outwardly from side walls 90*a* of tail aligner 90 and latch apertures 113 at the top of the shield snap behind latch bosses 95 at the top of the housing. In addition, ground contact arms 106 have enlarged mounting sections 106*a* for insertion into passages 89 in housing 76. The mounting sections have teeth stamped in opposite edges thereof for skiving into the plastic material of the housing within the passages. Therefore, shield 102 is secured to both the housing and the tail aligner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A shielded electrical connector for mounting on a printed circuit board in associated with an adapter for receiving a complementary mating connector, comprising:

a dielectric housing having a forward mating end and a rear terminating end with a plurality of terminal-receiving passages extending therebetween;

a plurality of terminals received in said passages and including tail portions projecting from the terminating end of the housing for connection to appropriate circuit traces on the printed circuit board; and a one-piece stamped and formed sheet metal shield about at least the rear terminating end of the housing and including at least one integral ESD clip projecting downwardly for insertion into an appropriate mounting hole in the printed circuit board, at least one integral ground contact arm projecting forwardly for engaging the complementary mating connector, at least one integral grounding tab projecting outwardly for engaging the adapter, and at least one integral grounding leg projecting downwardly for connection to an appropriate ground circuit on the printed circuit board.

2. The shielded electrical connector of claim 1 wherein said shield includes a top wall, a rear wall and a pair of side walls, with a pair of said ground contact arms projecting forwardly from the pair of side walls.

3. The shielded electrical connector of claim 2 wherein said at least one grounding leg projects downwardly from said rear wall.

4. The shielded electrical connector of claim 2 wherein said at least one grounding tab projects outwardly from said top wall.

5. The shielded electrical connector of claim 2, including a pair of said ESD clips projecting downwardly from the pair of side walls.

6. The shielded electrical connector of claim 5 wherein said at least one grounding leg projects downwardly from said rear wall.

7. The shielded electrical connector of claim 5 wherein said at least one grounding tab projects outwardly from said top wall.

8. The shielded electrical connector of claim 7 wherein said at least one grounding leg projects downwardly from said rear wall.

9. A shielded electrical connector for mounting on a printed circuit board in associated with an adapter for receiving a complementary mating connector, comprising:

a dielectric housing mounting a plurality of terminals which include tail portions projecting from the housing for connection to appropriate circuit traces on the printed circuit board; and a one-piece stamped and formed sheet metal shield mounted to the housing about the tail portions of the terminals and including at least one integral ESD clip for insertion into an appropriate mounting hole in the printed circuit board, at least one integral contact arm for engaging the complementary mating connector, at least one integral grounding tab for engaging the adapter, and at least one integral grounding leg for connection to an appropriate ground circuit on the printed circuit board.

10. The shielded electrical connector of claim 9 wherein said shield includes a top wall, a rear wall and a pair of side walls, with a pair of said ground contact arms projecting forwardly from the pair of side walls.

11. The shielded electrical connector of claim 10 wherein said at least one grounding leg projects downwardly from said rear wall.

12. The shielded electrical connector of claim 10 wherein said at least one grounding tab projects outwardly from said top wall.

13. The shielded electrical connector of claim 10, including a pair of said ESD clips projecting downwardly from the pair of side walls.

14. A shielded electrical connector for mounting on a printed circuit board in associated with an adapter for receiving a complementary mating connector, comprising:

a dielectric housing mounting a plurality of terminals which include tail portions projecting from the housing for connection to appropriate circuit traces on the printed circuit board; and a metal shield mounted to the housing about the tail portions of the terminals and including at least one ESD clip for insertion into an appropriate mounting hole in the printed circuit board, at least one ground contact arm for engaging the complementary mating connector and at least one grounding tab for engaging the adapter.

15. The shielded electrical connector of claim 14 wherein said at least one grounding tab projects outwardly from said top wall.

16. The shielded electrical connector of claim 14, including a pair of said ESD clips projecting downwardly from the pair of side walls.

* * * * *